US007556453B2

(12) United States Patent
Collina et al.

(10) Patent No.: US 7,556,453 B2
(45) Date of Patent: Jul. 7, 2009

(54) METHOD OF CONSTRUCTING A PILE FOUNDATION

(75) Inventors: Vincenzo Collina, Villagrappa (IT); Roberto Zago, Rovereto (IT); Lamberto Zambianchi, Villafranca (IT)

(73) Assignee: SO. L.E.S. -Societa' Lavori Edili E Serbatoi S.p.A., Forli' (IT)

( * ) Notice: Subject to any disclaimer, the term of this patent is extended or adjusted under 35 U.S.C. 154(b) by 311 days.

(21) Appl. No.: 10/573,496

(22) PCT Filed: Sep. 24, 2003

(86) PCT No.: PCT/IT03/00568

§ 371 (c)(1),
(2), (4) Date: Nov. 6, 2006

(87) PCT Pub. No.: WO2005/028789

PCT Pub. Date: Mar. 31, 2005

(65) Prior Publication Data

US 2007/0065233 A1 Mar. 22, 2007

(51) Int. Cl.
*E02D 27/48* (2006.01)

(52) U.S. Cl. ..... 405/230; 405/229; 405/232

(58) Field of Classification Search ..... 405/229, 405/230, 231, 232

See application file for complete search history.

(56) References Cited

U.S. PATENT DOCUMENTS

| | | | | |
|---|---|---|---|---|
| 3,786,641 A | | 1/1974 | Turzillo | |
| 4,591,466 A | * | 5/1986 | Murray et al. | 405/230 |
| 5,013,190 A | * | 5/1991 | Green | 405/230 |
| 5,205,673 A | * | 4/1993 | Bolin et al. | 405/230 |
| 5,234,287 A | * | 8/1993 | Rippe, Jr. | 405/230 |
| 5,269,630 A | * | 12/1993 | Bolin et al. | 405/230 |

FOREIGN PATENT DOCUMENTS

| | | |
|---|---|---|
| CN | 2055863 | 4/1990 |
| CN | 1182818 | 5/1998 |
| WO | PCT/IT2003/000568 | 5/2004 |

OTHER PUBLICATIONS

China Office Action dated May 9, 2008, Appl. No. 038271133 entitled, "Method of Constructing a Pile Foundation".
CN1182818 CN Translated Abstract.

* cited by examiner

*Primary Examiner*—Frederick L Lagman
(74) *Attorney, Agent, or Firm*—Pequignot + Myers LLC

(57) ABSTRACT

A method of constructing a pile foundation, wherein a foundation structure is built on the ground, and has at least one through hole, and a connecting member fixed to the foundation structure, adjacent to the hole, and having at least one portion projecting upwards; a pile is inserted through the hole; and a number of thrusts are applied statically on the pile, to drive the pile into the ground, by means of a thrust device, which is located over the pile, cooperates with a top end of the pile, and is connected to the projecting portion of the connecting member which, when driving the pile, acts as a reaction member for the thrust device.

72 Claims, 9 Drawing Sheets

METHOD OF CONSTRUCTING A PILE FOUNDATION

This is the U.S. national stage of International application PCT/IT2003/000568, filed Sep. 24, 2003 designating the United States.

TECHNICAL FIELD

The present invention relates to a method of constructing a pile foundation, in particular of a building.

BACKGROUND ART

A pile foundation of a building is constructed by building a ground foundation structure of the building, having at least one through hole and fitted through, adjacent to the hole, with at least two cables fixed to the structure and projecting upwards. Once the foundation structure is completed, a metal pile is inserted through the hole and subjected to a series of static thrusts to drive it into the ground; and, once driven, the top of the pile is fixed axially to the foundation structure. Each thrust is applied by a thrust device, which is set up on top of the pile, cooperates with the top end of the pile, and is connected to the projecting portions of the cables, which, when driving the pile, act as reaction members for the thrust device.

The pile comprises a constant-section rod; and a wide bottom head, which is connected integrally to the rod and substantially the same size across as the hole so as to fit through it. When driving the pile, the head forms, in the ground, a channel larger across than the rod, and, as the pile is being driven, substantially plastic cement is fed into the part of the channel not occupied by the rod, so as to form a cement jacket about the pile.

Especially in soft ground, the transverse dimensions of the head should be particularly large to form a relatively large channel in the ground and, hence, a cement jacket large enough to ensure the required stability. The transverse dimensions of the head, however, are limited by those of the hole, which, over and above a given size, seriously impairs the capacity of the foundation structure, and makes it difficult to fix the sunk pile axially to the foundation structure.

DISCLOSURE OF INVENTION

It is an object of the present invention to provide a method of constructing a pile foundation, designed to eliminate the aforementioned drawbacks, and which, at the same time, is cheap and easy to implement.

It is a further object of the present invention to provide a pile for constructing a pile foundation, designed to eliminate the aforementioned drawbacks, and which, at the same time, is cheap and easy to build.

According to the present invention, there is provided a method of constructing a pile foundation, as claimed in claim 1 and, preferably, in any one of the following Claims depending directly or indirectly on claim 1.

According to the present invention, there is provided a method of constructing a pile foundation, as claimed in claim 94 and, preferably, in any one of the following Claims depending directly or indirectly on claim 94.

According to the present invention, there is provided a method of constructing a pile foundation, as claimed in claim 111 and, preferably, in any one of the following Claims depending directly or indirectly on claim 111.

According to the present invention, there is provided a pile for constructing a pile foundation, as claimed in claim 113 and, preferably, in any one of the following Claims depending directly or indirectly on claim 113.

According to the present invention, there is provided a pile for constructing a pile foundation, as claimed in claim 114 and, preferably, in any one of the following Claims depending directly or indirectly on claim 114.

According to the present invention, there is provided a pile for constructing a pile foundation, as claimed in claim 115 and, preferably, in any one of the following Claims depending directly or indirectly on claim 115.

According to the present invention, there is provided a pile for constructing a pile foundation, as claimed in claim 116 and, preferably, in any one of the following Claims depending directly or indirectly on claim 116.

BRIEF DESCRIPTION OF THE DRAWINGS

A number of non-limiting embodiments of the present invention will be described by way of example with reference to the accompanying drawings, in which:

FIG. 4 shows the FIG. 1 pile driven in;

BEST MODE FOR CARRYING OUT THE INVENTION

Figure 1:
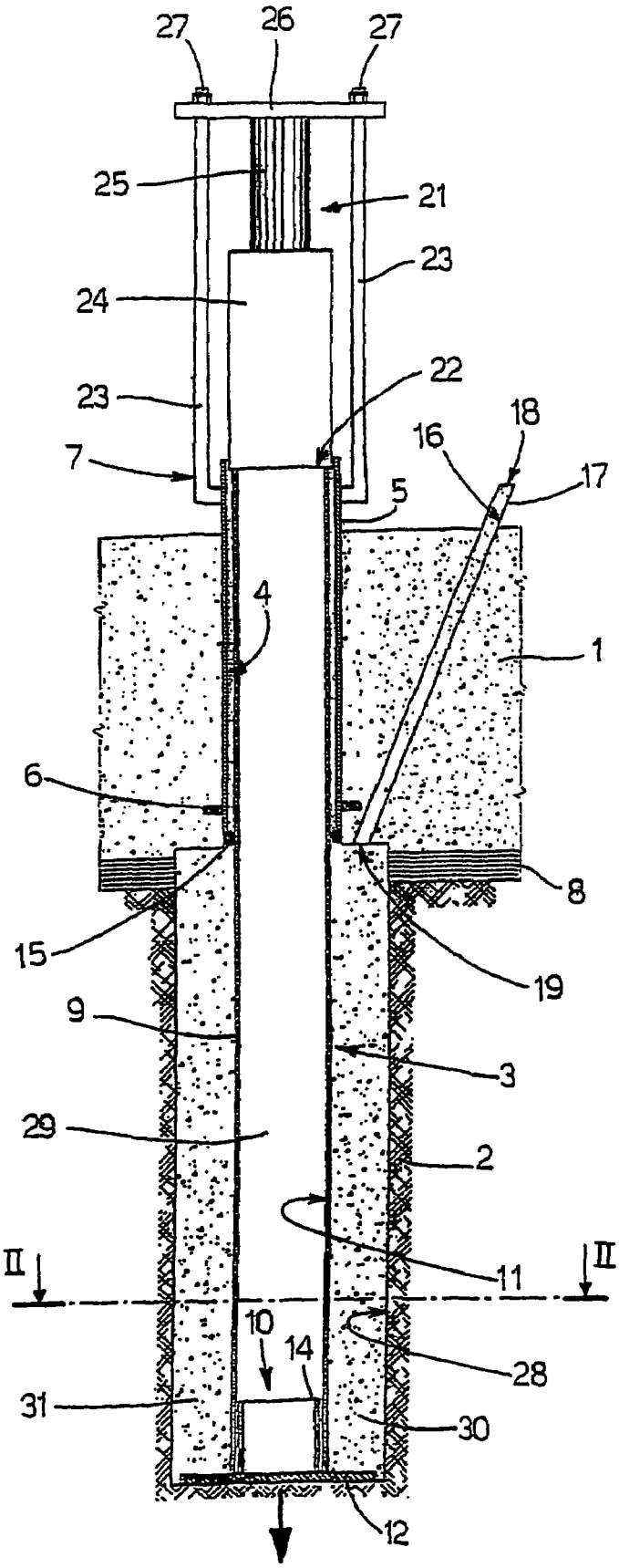
FIG. 1 shows a schematic front section of a foundation pile which is driven using the method according to the present invention.

Number 1 in FIG. 1 indicates a foundation structure of a building (not shown), which is built on the ground 2 and is normally defined by a continuous beam, a slab, or reinforced concrete footings. Foundation structure 1 may obviously be used for a building, for any other type of building structure (e.g. a bridge), and more generally for any structure requiring a ground foundation (e.g. a hydraulic turbine, industrial boiler, or electric pylons).

Foundation structure 1 is normally buried, and transfers the loads on it to ground 2 by means of a number of piles 3 (only one shown) extending through and downwards from the structure. For which purpose, for each pile 3, structure 1 comprises a substantially vertical hole 4, of cylindrical or other shaped cross section, and lined with a metal pipe 5, which is fixed to foundation structure 1 by a ring 6 incorporated in structure 1, and projects upwards from foundation structure 1 by a top portion 7. A layer 8 of relatively poor, so-called "lean" cement is preferably interposed between foundation structure 1 and ground 2; and a number of fastening rings 6 may be provided at different levels.

In alternative embodiments depending on the construction characteristics of the building, foundation structure 1 may be built either entirely, or from an existing structure in which, for example, holes 4 are formed. To increase the mechanical strength of an existing foundation structure 1, or to construct a foundation structure 1 of reduced thickness, each hole 4 may be surrounded by a metal plate, which obviously has a central hole at hole 4, is connected to foundation structure 1 by means of screws, and preferably rests on the top surface of foundation structure 1.

Each pile 3 is made of metal, and comprises a substantially constant-section rod 9, normally defined by a number of tubular segments of equal length welded end to end; and at least one wide bottom main head 10 defining the bottom end of pile 3. Rod 9 may obviously be other than circular in section, and may also be solid.

Figure 2:
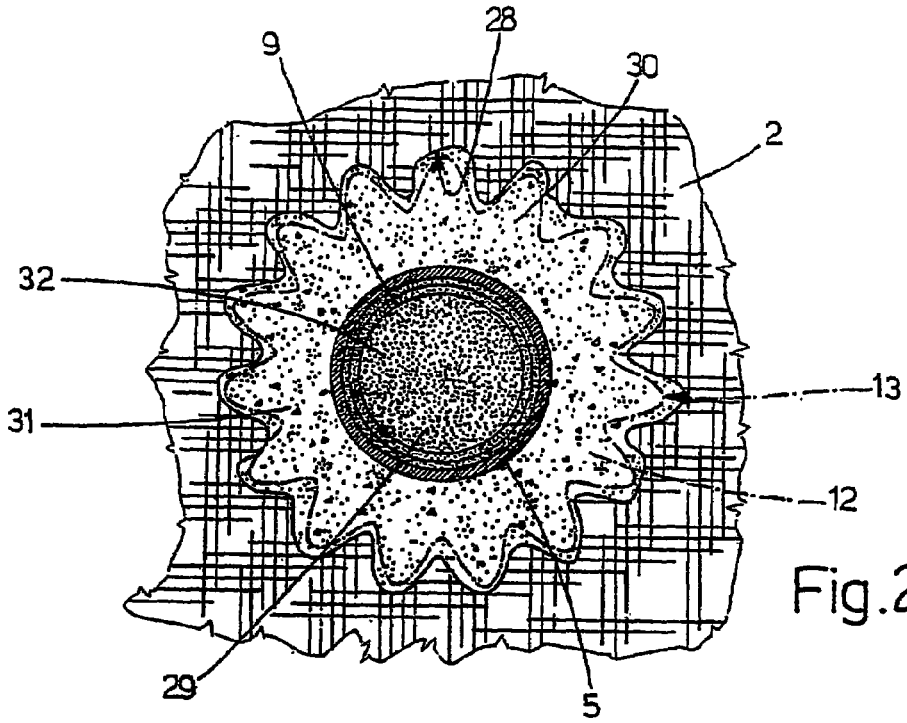
FIG. 2 shows a section along line II-II of the FIG. 1 pile.
Figure 3:
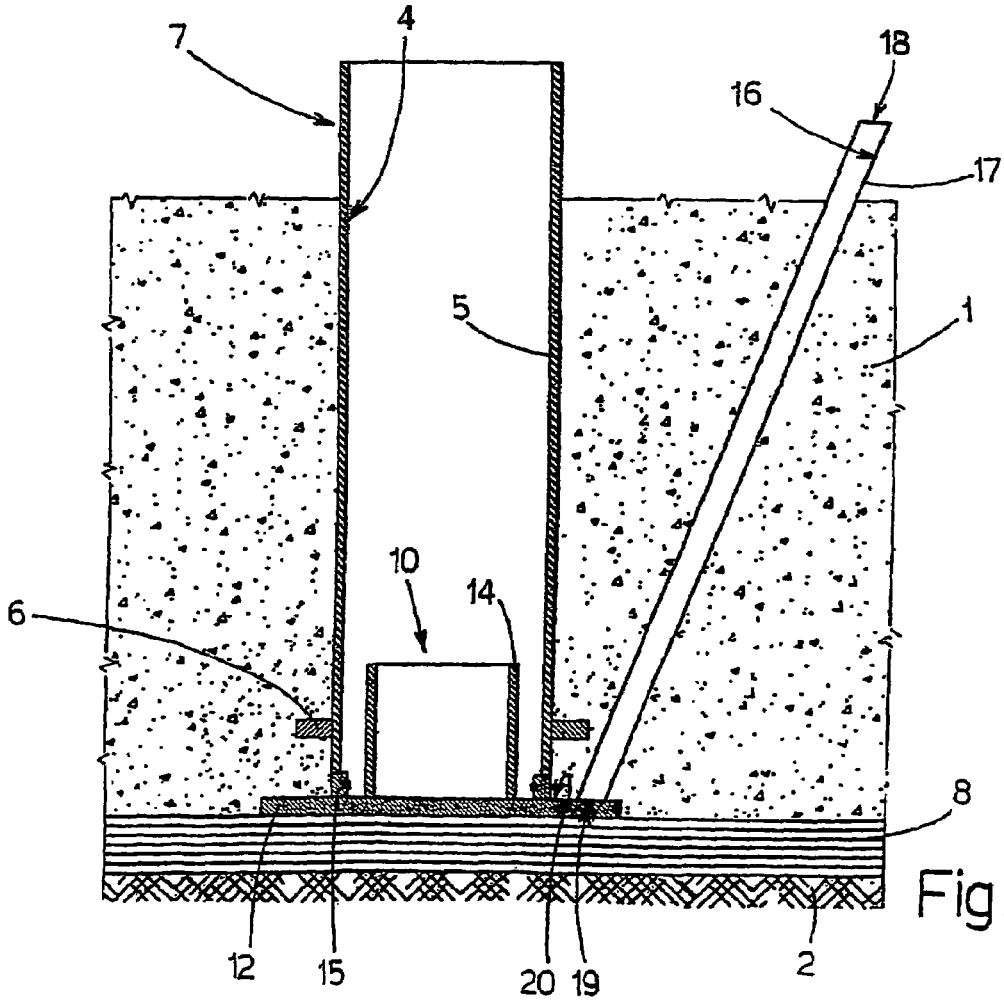
FIG. 3 shows a larger-scale front section of an initial configuration, prior to driving the FIG. 1 pile.

Each rod 9 is tubular in shape, has a through inner conduit 11, and is smaller across than relative hole 4 so as to fit relatively easily through hole 4. Each main head 10 is defined by a flat, substantially circular plate 12 having a jagged outer edge 13 (FIG. 2), but which may obviously be shaped differently, e.g. circular, square or rectangular, with a jagged or smooth edge. Each main head 10 is larger or the same size across as relative hole 4, is initially detached from respective rod 9, and, when constructing foundation structure 1, is placed substantially contacting ground 2 beneath foundation structure 1, and coaxial with relative hole 4 (as shown in FIG. 3) consequently, each rod 9, as it is fitted through relative hole 4, engages relative main head 10 to form relative pile 3.

In the case of an existing foundation structure 1, to install main head 10, a hole is formed in foundation structure 1, which is then partly restored to obtain a hole 4 smaller across than main head 10.

To ensure sufficiently firm mechanical connection of each rod 9 and relative main head 10, main head 10 is provided with a connecting member 14, which engages rod 9 to fix rod 9 transversely to main head 10. In the embodiments shown, for example, each connecting member 14 is defined by a cylindrical tubular member projecting axially from plate 12 and so sized as to engage a bottom portion of inner conduit 11 of relative rod 9 with fairly little clearance. Connecting member 14 may obviously be formed differently.

A bottom end portion of each pipe 5 is fitted with at least one sealing ring 15, which is made of elastic material and engages the outer cylindrical surface of rod 9 of pile 3, when pile 3 is fitted through corresponding hole 4.

When building foundation structure 1, at least one injection conduit 16 is formed at each hole 4, is defined by a metal pipe 17 extending through foundation structure 1, and has a top end 18 projecting from structure 1, and a bottom end 19 adjacent to hole 4 and contacting a top surface 20 of plate 12 of relative main head 10.

To drive each pile 3 into ground 2, relative rod 9 is first inserted through relative hole 4 to engage (as described previously) relative main head 10 located beneath foundation structure 1, contacting ground 2, and coaxial with relative hole 4.

As shown in FIG. 1, once rod 9 engages relative main head 10 to define relative pile 3, a thrust device 21, which cooperates with a top end 22 of pile 3, is set up over pile 3 and connected to projecting portion 7 of relative pipe 5 by means of two ties 23 threaded at the top. More specifically, thrust device 21 is defined by at least one hydraulic jack comprising a body 24, and an output rod 25 movable axially with adjustable force with respect to body 24. Body 24 is supported on top end 22 of pile 3, and rod 25 is brought into contact with a bottom surface of a metal plate 26 fitted through with ties 23 and made axially integral with ties 23 by means of respective bolts 27 engaging the threaded top portions of ties 23.

Once fitted to pile 3 as described above, thrust device 21 is activated to generate a force of given intensity between body 24 and rod 25, which force produces static thrust, of the same intensity as the force, on pile 3 to drive it into ground 2. The reaction to the thrust exerted by thrust device 21 is provided by the weight of foundation structure 1 (to which appropriate ballast resting on foundation structure 1 may be added) and is transmitted by ties 23, which, together with relative pipe 5, act as reaction members by maintaining a fixed distance between plate 26 and foundation structure 1 as rod 25 is extracted from body 24, so that body 24 is forced downwards together with top end 22 of pile 3.

Thrust device 21 may obviously be formed differently, providing static thrust is exerted on pile 3 to drive it into ground 2. For example, thrust device 21 may comprise two hydraulic jacks on opposite sides of rod 9; the movable rod of each hydraulic jack is fixed to a horizontal plate connected rigidly to pipe 5 and, therefore, to foundation structure 1; and the bodies of the two hydraulic jacks engage and grip rod 9 between them so as to draw rod 9 down as the hydraulic jack rods are extracted from the bodies. More specifically, the bodies of the two hydraulic jacks grip rod 9 by means of wedges which compress rod 9 as the hydraulic jack bodies move down. When the jack rods are fully extended, the gripping action on rod 9 is eliminated by reducing the pressure on the wedges, and the jack rods return to the starting position to continue driving rod 9.

In an alternative embodiment not shown, as opposed to being connected to the projecting portion 7 of pipe 5, ties 23 of thrust device 21 are connected to physically separate drive ballast not resting on foundation structure 1, so that the reaction member for driving pile 3 is defined, not by foundation structure 1, but solely by the drive ballast. Alternatively, the reaction member may be defined by both foundation structure 1 and the drive ballast, which, as stated, is physically separate from, as opposed to resting on, foundation structure 1. To increase the reaction force generated by the drive ballast, without recourse to excessively heavy drive ballast (which would be bulky and difficult to move), the drive ballast may be secured to ground 2 by screws driven temporarily into ground 2 outside foundation structure 1. The drive ballast may also be defined by a movable body, e.g. a wheel-mounted truck or a barge or pontoon, which can be positioned easily close to hole 4, or may be defined by auxiliary piles or screws driven temporarily into ground 2 to act as reaction members when driving pile 3, and which are removed once pile 3 is driven.

The above embodiment is obviously used to avoid stressing a particularly fragile foundation structure 1.

As each pile 3 is driven into ground 2, main head 10 forms in ground 2 a channel 28 of substantially the same shape and transverse dimensions as main head 10 itself. Channel 28 is divided into an inner cylindrical portion 29 occupied by relative rod 9; and a substantially clear outer tubular portion 30, into which, as pile 3 is being driven into ground 2, substantially plastic cement material 31 is pressure-injected simultaneously along relative injection conduit 16. More specifically, cement material 31 substantially comprises cement and sand or so-called "betoncino", which is a concrete having features similar to the mortar; 1 cube meter of "betoncino" is made by 550 Kg of Portland-type cement, 150 Kg of water, 1425 Kg of sand, and some fluidiser) so as to be particularly fluid for easy pressure-injection along injection conduit 16. A number of injection conduits 16 may obviously be provided for each pile 3, to supply cement material 31 either simultaneously or successively.

Sealing ring 15 prevents the pressure-injected cement material 31 from seeping upwards through the gap between the outer surface of rod 9 and the inner surface of relative pipe 5.

In an alternative embodiment, cement material 31 may contain additives (e.g. bentonite) to reduce adhesion of ground 2 to cement material 31 as it dries. Such additives may be used when ground 2 has a tendency to shrink over time (e.g. as in the case of peat layers). In which case, preventing adhesion to cement material 31 allows ground 2 to eventually shrink freely and naturally.

In a further embodiment, cement material 31 contains waterproofing additives, which make it substantially impermeable to water even prior to curing. Such additives are necessary when pile 3 is driven through a water bed, particularly containing high-pressure and/or relatively fast-flowing water, and serve to prevent water from mixing with and so deteriorating cement material 31. Tests have also shown that, when working through a moving water bed, it is important to inject cement material 31 at a higher pressure than that exerted by the moving water, so as to further reduce the likelihood of water mixing with cement material 31.

As stated, each rod 9 is divided into a number of segments, which are driven successively, as described, through relative hole 4, and are welded together to define pile 3. More specifically, once a first segment of rod 9 is driven, thrust device 21 is detached from the top end of the first segment to insert a second segment, which is butt welded to the first segment; thrust device 21 is then connected to the top end of the second segment to continue the drive cycle. In an alternative embodiment not shown, two successive tubular segments are fixed together by a connecting portion, which partly engages the inner conduits of the two segments. The component segments of each rod 9 are normally identical, but, in certain situations, may differ in length, shape or thickness.

Depending on the structural characteristics of foundation structure 1 and the characteristics of ground 2, each pile 3 is assigned a rated capacity, i.e. a weight which must be supported by pile 3 without yielding, i.e. without breaking and/or sinking further into ground 2. To ensure the rated capacity is met, each pile 3 is normally driven until it is able to withstand thrust by thrust device 21 in excess of the rated capacity without sinking further into ground 2. This is made possible by piles 3 being driven into ground 2 one at a time. When driving each pile 3, therefore, practically the whole weight of foundation structure 1 (to which appropriate ballast may be added) can be used as a reaction force to the thrust exerted by relative thrust device 21. As already stated, the reaction force may of course be provided wholly or partly by drive ballast independent of foundation structure 1.

Figure 4:
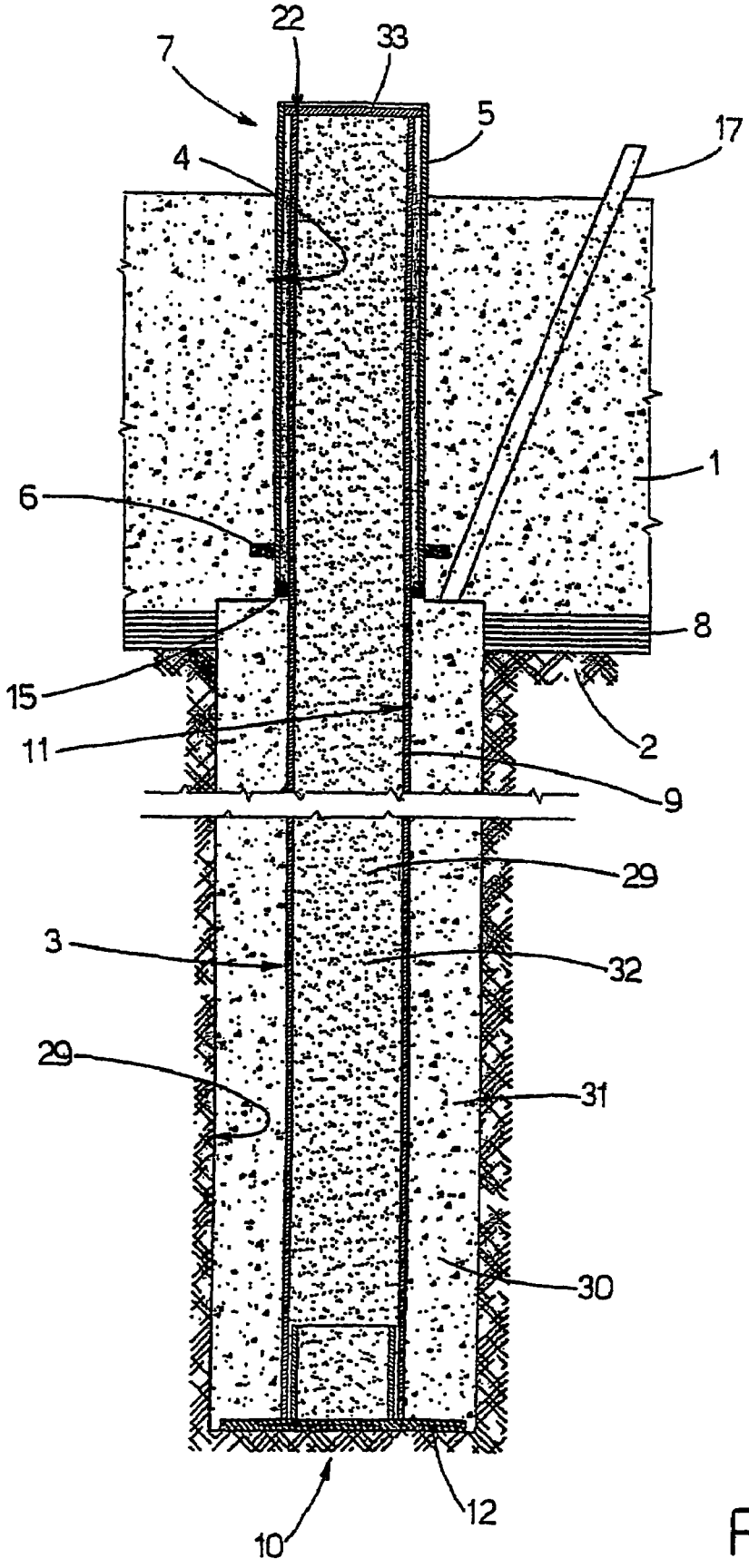

As shown in FIG. 4, once each pile 3 is driven, the corresponding thrust device 21 is removed from pile 3, and the relative inner conduit 11 is filled with substantially plastic cement material 32, in particular "concrete". Once the inner conduit 11 of each pile 3 is filled, pile 3 is fixed axially to foundation structure 1 by securing (normally welding) to the projecting portion 7 of relative lining pipe 5 a horizontal metal plate 33 (or an annular flange), which is fitted on top of pile 3 to engage top end 22.

In a further embodiment not shown, rod 9 is not filled with cement material 32, and, as opposed to having a tubular section, is preferably solid with no inner conduit 11.

In an alternative embodiment not shown, a body of elastic material (e.g. neoprene) is inserted inside lining pipe 5 and between top end 22 of pile 3 and metal plate 33, generally for the purpose of improving earthquake resistance of foundation structure 1.

In a further embodiment not shown, each pile 3 is driven so that top end 22 is below the top surface of foundation structure 1; projecting portion 7 of pipe 5 is then cut; and plate 33 is fixed to the rest of pipe 5 so as to be substantially coplanar with the top surface of foundation structure 1, and so obtain a foundation structure 1 with a fully walk-on top surface.

Before being fixed axially to foundation structure 1, pile 3 can be preloaded with a downward thrust of given intensity throughout the time taken to weld metal plate 33 to lining pipe 5. In other words, pile 3 is subjected to downward thrust of given intensity while welding metal plate 33 to lining pipe 5. Preloading pile 3 as it is being fixed to foundation structure 1 allows any yield of pile 3 to occur rapidly as opposed to over a long period of time. Rectifying any yield of one or more piles 3 is a relatively straightforward, low-cost job when building foundation structure 1, but is much more complex and expensive once foundation structure 1 is completed.

In soft ground, such as silt or peat, channel 28, formed by main head 10 as it is driven into ground 2, may be partly or completely clogged by so-called "caving" portions of ground 2, which are pushed inside channel 28 by the pressure exerted by main head 10 on ground 2. The caving ground clogging channel 28 prevents portion 30 from being filled completely with cement material 31, thus impairing, even seriously, the final capacity of pile 3. The caving phenomenon is in direct proportion to the softness of ground 2 and the pressure exerted on ground 2 by main head 10.

Figure 6:
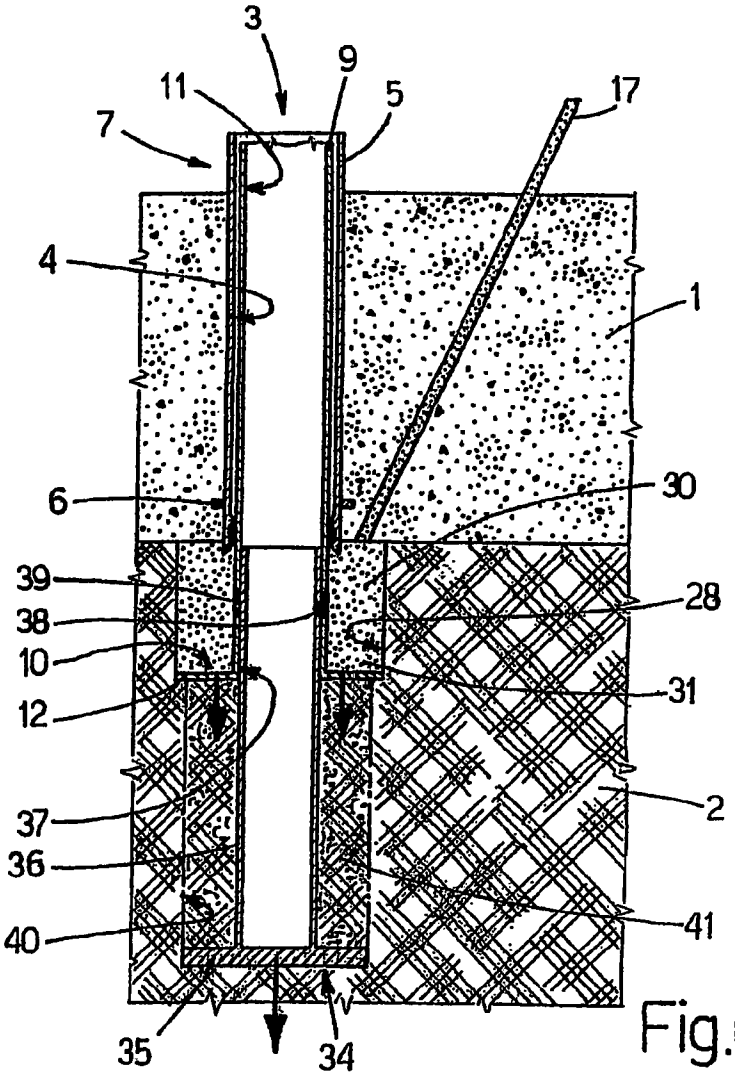
FIGS. 5 and 6 show two stages in the driving of an alternative embodiment of the FIG. 1 pile.
Figure 5:
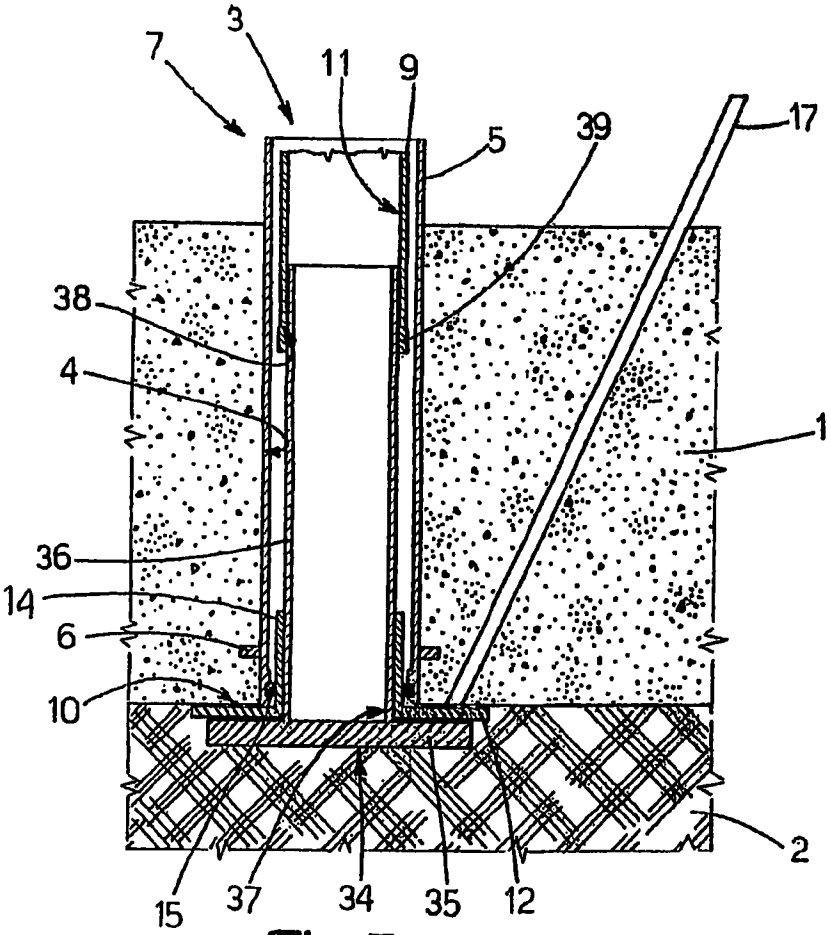

The above drawback is solved using the embodiment shown in FIGS. 5 and 6, in which, in addition to main head 10, pile 3 also comprises a lead-in head 34 located beneath foundation structure 1, beneath and coaxial with main head 10 (FIG. 5). Lead-in head 34 comprises a circular plate 35 connected to a tubular body 36, which extends upwards through a circular opening 37 in main head 10, and engages a bottom end 38 of rod 9. Tubular body 36 is so sized across as to be partly insertable inside conduit 11 of rod 9 inserted through hole 4; and insertion of tubular body 36 inside rod 9 is arrested by a ring 39 fixed to the outer surface of tubular body 36.

In actual use, rod 9 is inserted inside hole 4 and engages the top portion of tubular body 36 as described above; as bottom end 38 of rod 9 contacts ring 39, further downward movement of rod 9 produces an equal downward movement of tubular body 36, which slides inside opening 37 and pushes lead-in head 34 down into ground 2, while main head 10 initially remains stationary in its original position.

As it continues moving down, the bottom end 38 of rod 9, with ring 39 in between, contacts the top end of connecting member 14 of main head 10, thus also pushing main head 10 down into ground 2.

Main head 10, in particular plate 12, is slightly larger across than lead-in head 34, in particular plate 35 of lead-in head 34, so that main head 10 is maintained a constant distance from lead-in head 34 at all times when driving pile 3 into ground 2.

As pile 3 is driven into ground 2, lead-in head 34 exerts considerable pressure on ground 2, and forms, in ground 2, a channel 40 which is therefore highly susceptible to said caving phenomenon (indicated 41 in FIG. 6). Main head 10, on the other hand, exerts relatively little pressure on ground 2, and so provides for "reaming" channel 40 and forming channel 28, which is therefore less susceptible to caving, so that cement material 31 fed into portion 30 encounters substantially no obstacles.

As pile 3 is driven into ground 2, at least 1 meter distance is maintained between main head 10 and lead-in head 34 to prevent caving of channel 28 caused by the pressure exerted on ground 2 by lead-in head 34.

In the FIG. 1-4 embodiment, pile 3 comprises one main head 10 which, as it is driven in, forms in ground 2 channel 28 which is filled with cement material 31. In the FIGS. 5 and 6 embodiment, pile 3 comprises main head 10 which, as it is driven in, forms in ground 2 channel 28 which is filled with cement material 31; and lead-in head 34 which, as it is driven in, forms in ground 2 channel 40 which defines a "lead-in" channel by which to drive in main head 10.

In a further embodiment not shown, pile 3 comprises main head 10 which, as it is driven in, forms in ground 2 channel 28 which is filled with cement material 31; and a number of (normally two to four) lead-in heads 34 which, as they are driven in, form in ground 2 channel 40 which defines a "lead-in" channel by which to drive in main head 10. The transverse dimensions of lead-in heads 34 increase gradually to gradually increase the transverse dimensions of channel 40; and the number of lead-in heads 34 used depends on the type of ground 2. In special cases, the transverse dimensions of lead-in heads 34 may decrease gradually, so as to have a very wide bottom lead-in head 34 and a wide supporting base, and a smaller main head 10 and/or smaller upper lead-in heads 34 to reduce the size of channel 30 and therefore the amount of cement material 31 injected into ground 2.

Figure 11:
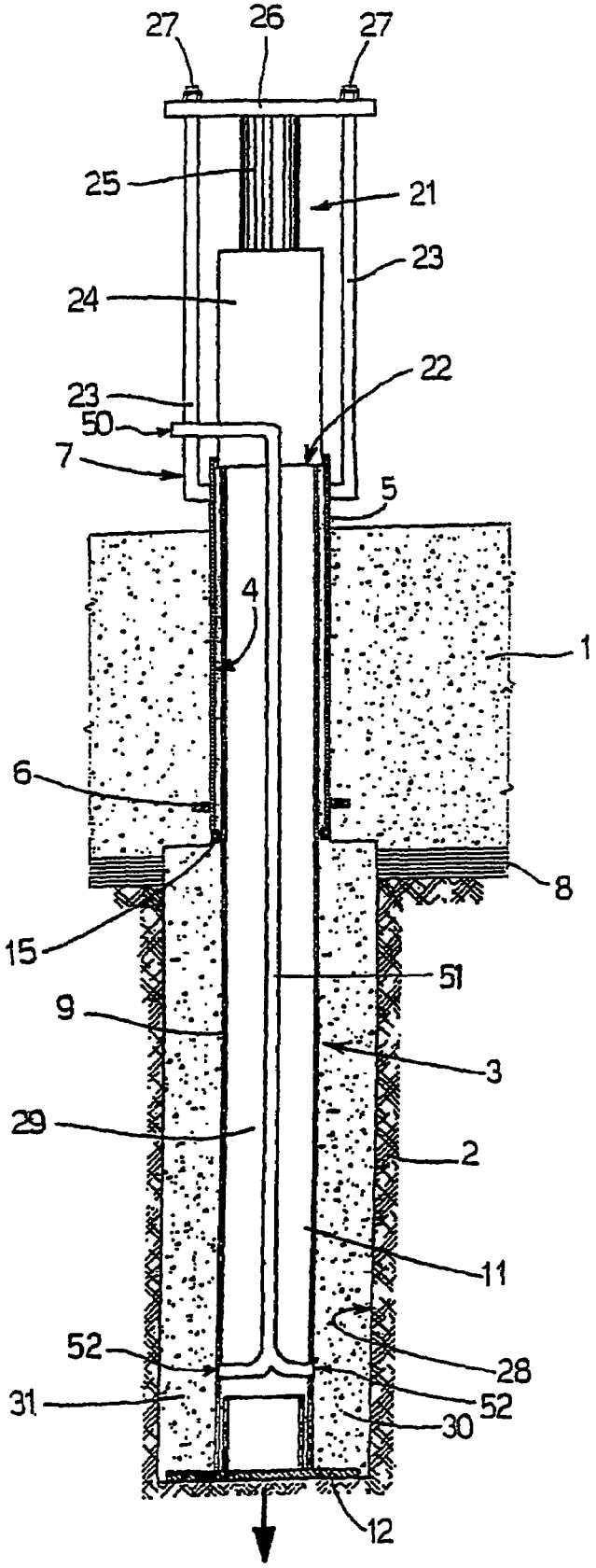
FIG. 11 shows a front section of an alternative embodiment of the FIG. 1 pile.

In an alternative embodiment, cement material 31 may be injected into channel 40 formed by driving a lead-in head 34 into ground 2; in which case, the injection conduit used (not shown in detail) is identical to injection conduit 50 shown in the FIG. 11 embodiment, and is defined by a pipe having a bottom end located at a through hole in tubular body 36, and a top end connected to an injection device.

Each pile 3 may therefore have more than one main head 10 and more than one lead-in head 34, which heads 10 and 34 may be of different sizes and different distances apart. Moreover, the transverse dimensions of each main head 10 or lead-in head 34 may vary both in the course of and after driving pile 3; and the channel formed by driving any one main head 10 or lead-in head 34 may be filled with cement material 31 in one stage or in a number of successive time-separated stages.

In an alternative embodiment, a lead-in head 34 is fixed to and made slidable with respect to respective tubular body 36 by a connecting mechanism. That is, when driving pile 3, it may be decided to arrest the downward movement of lead-in head 34 at a certain point, and continue solely with the downward movement of tubular body 36. The connecting mechanism may be remote controlled by an actuator, or may be designed to release slide of lead-in head 34 with respect to tubular body 36 when the force exerted on lead-in head 34 exceeds a predetermined threshold value. Similarly, main head 10 may be fixed to and made slidable with respect to rod 9 by a connecting mechanism. That is, when driving pile 3, it may be decided to arrest the downward movement of main head 10 at a certain point, and continue solely with the downward movement of rod 9. The connecting mechanism may be remote controlled by an actuator, or may be designed to release slide of main head 10 with respect to rod 9 when the force exerted on main head 10 exceeds a predetermined threshold value.

Figure 7:
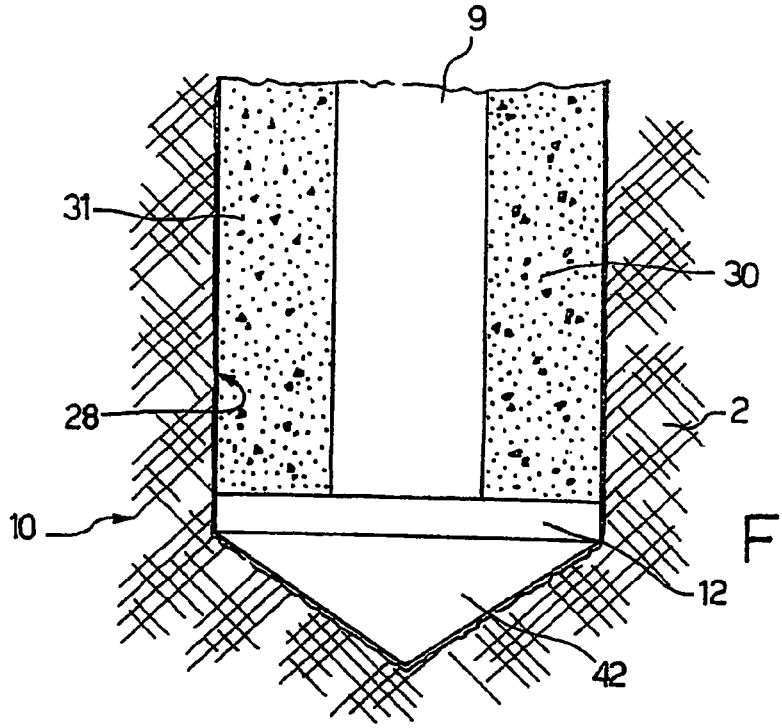
FIGS. 7 and 8 show larger-scale front sections of two alternative embodiments of a detail of the FIG. 1 pile.

In the alternative embodiment shown in FIG. 7, the bottom portion of main head 10 is pointed. More specifically, the underside of plate 12 of main head 10 is fitted rigidly with a pointed body 42, which may be conical or wedge-shaped or any other shape terminating in a pointed tip. The inclination of the tip of body 42 may be fixed or variable (in particular, may click between two positions) for adjustment, when driving pile 3, as a function of the characteristics of ground 2 being worked by main head 10. In other words, at any time when driving the pile, the inclination of the tip of body 42 may be varied to adapt to the characteristics of ground 2 being worked at that time by main head 10.

A pointed main head 10 has the advantage of being driven into ground 2 more easily, and above all of preventing downward thrust of the portion of ground 2 dislodged by main head 10 as it is driven in. That is, as the pointed main head 10 moves down, the portion of ground 2 dislodged by main head 10 tends to slide along the sloping walls of the tip and be pushed away on either side of main head 10. In other words, in the case of a flat main head 10, the portion of ground 2 dislodged as main head 10 moves down tends to be at least partly pushed down by main head 10; whereas, in the case of a pointed main head 10, the portion of ground 2 dislodged as main head 10 moves down tends, as stated, to slide along the sloping walls of the tip to either side of main head 10.

Preventing downward thrust of the portion of ground 2 dislodged as main head 10 moves down is extremely important when driving main head 10 through two layers of different compositions, which must be prevented from mixing. This situation normally occurs in the presence of a water bed, which must be safeguarded against pollution by entrained material from the layers of ground 2 above the bed.

Figure 8:
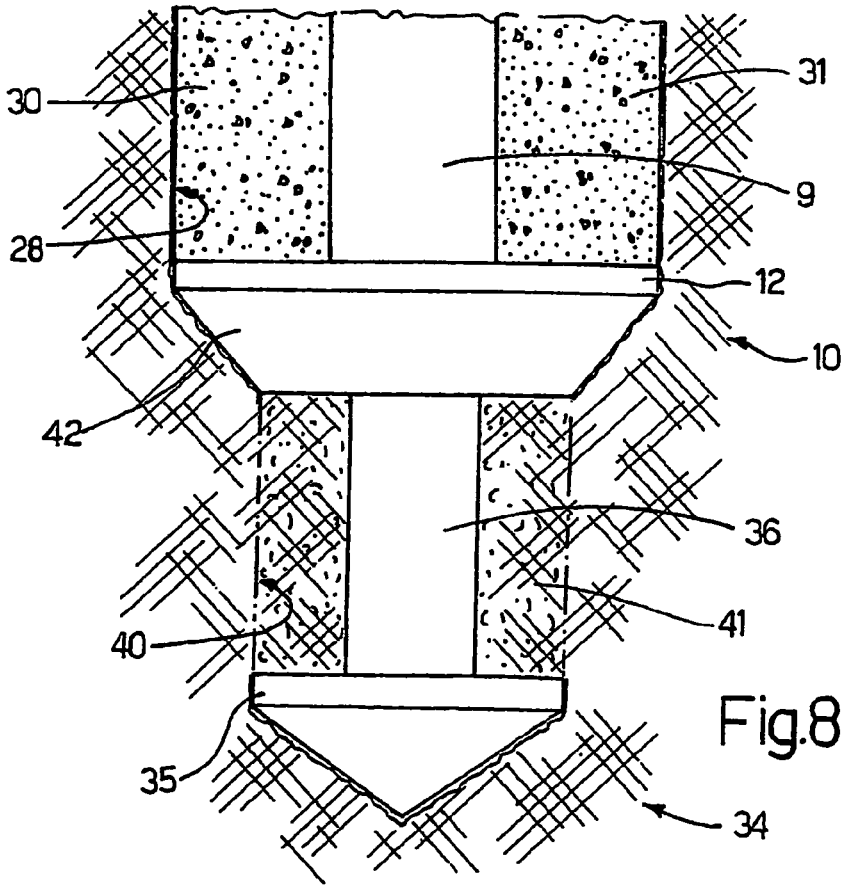

In the case of a pile 3 comprising a main head 10 and a number of lead-in heads 34, only the bottom lead-in head 34 can be pointed. Alternatively, as shown in FIG. 8, the lead-in heads 34 and main head 10 are all pointed (fixed or adjustable), but obviously only the bottom lead-in head 34 is fully pointed, while the other lead-in heads 34 and the main head 10 are pointed with a centre hole for passage of the lower lead-in heads 34.

As it is being driven into ground 2, main head 10 may be rotated at a given, normally variable, speed about its central axis to assist penetration of ground 2 by main head 10. Rotation is particularly useful in the case of a pointed main head 10, in which case, main head 10 preferably comprises a number of helical grooves to screw main head 10 into ground 2. Alternatively, main head 10 may be screwed into ground 2 with or without material extraction from channel 28. Material extraction from channel 28 is particularly useful to overcome layers of particularly tough ground.

When driving pile 3, rod 9 of pile 3 may be rotated slightly about its vertical axis to compensate for any deviation of rod 9 with respect to the vertical, caused by being driven through particularly tough points of ground 2, such as concrete headers or boulders.

Figure 9:
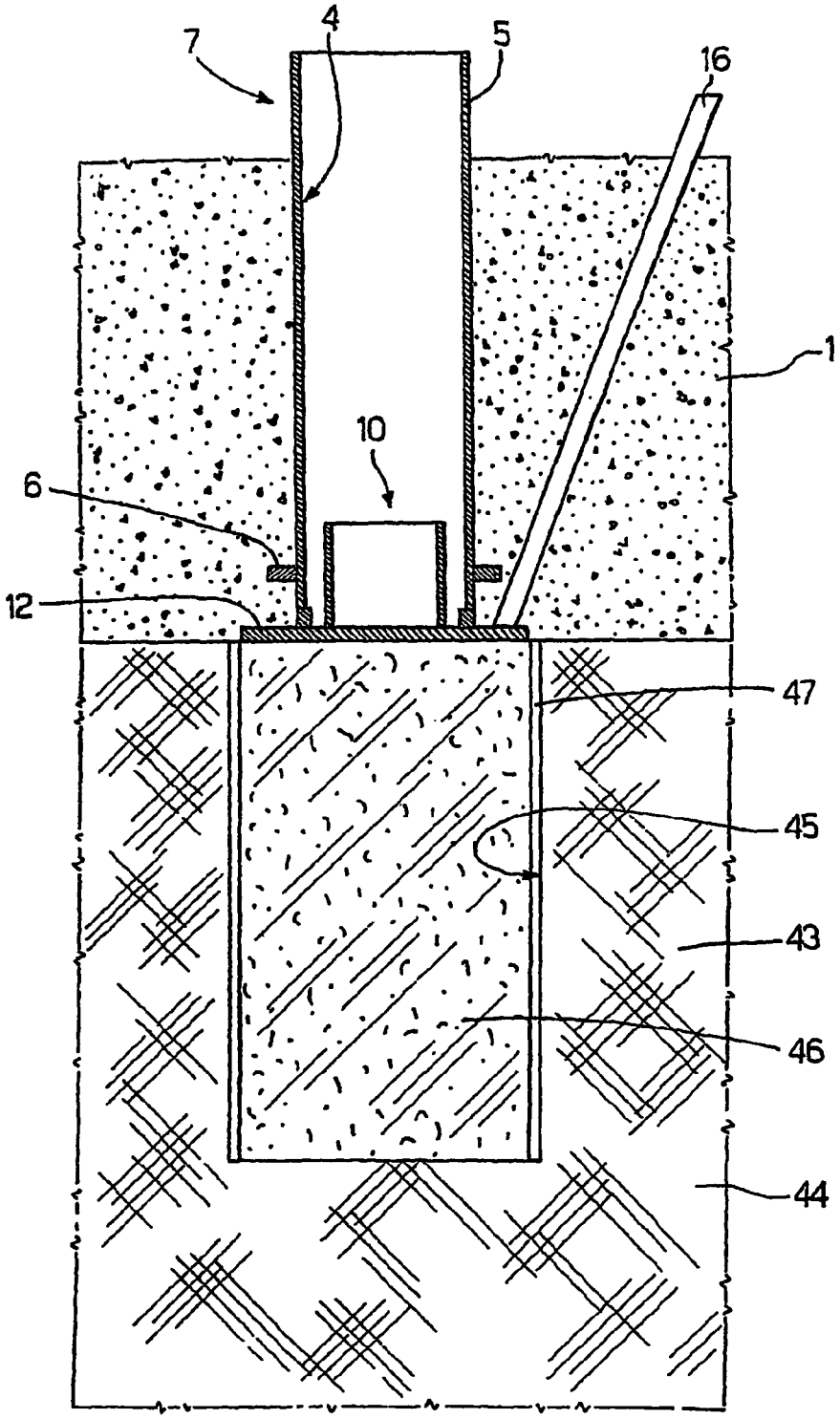
FIG. 9 shows a front section of a further embodiment of the FIG. 1 pile.

In the FIG. 9 embodiment, in the event ground 2 comprises a highly compact, tough upper layer 43, and a less compact, softer lower layer 44, a pre-channel 45 may be formed through upper layer 43 using a normal drill (possibly with bits increasing gradually in size). Pre-channel 45 is obviously coaxial with pipe 5, and therefore with main head 10 and with channel 28 formed by driving main head 10 into ground 2, and provides for driving main head 10 more easily into upper layer 43 of ground 2.

Pre-channel 45 may be smaller, the same size, or slightly larger across than main head 10, and may be filled with low-strength material 46 (e.g. sand) to ensure correct formation of pile 3, and to prevent ground 2 from caving in and clogging pre-channel 45 with heterogeneous material (e.g. rubble) which might hinder the downward movement of main head 10. In the preferred embodiment shown in FIG. 9, pre-channel 45 is slightly larger across than main head 10, and is lined with a liner 47 of sheet metal (or other material, such as PVC) to prevent ground 2 from caving into pre-channel 45. Once sheet metal liner 47 is in place, pre-channel 45 is filled with low-strength material 46 to ensure correct formation of pile 3. It is important, in fact, that, as it moves down, main head 10 should encounter as little resistance as possible, so as to exert sufficient pressure on ground 2 to compact it locally.

Obviously, if the same size across as main head 10. i.e. if larger across than hole 4, pre-channel 45 must be formed before building foundation structure 1. When driving main head 10, pre-channel 45 may be at least partly flooded with water; in which case, the water may be sucked out of pre-channel 45 along injection conduit 16, possibly by inserting a pipe connected along injection conduit 16 to a suction pump.

In the event ground 2 comprises weak (e.g. clay) layers alternating with tough (e.g. sand) layers, to maintain a relatively constant drive pressure of pile 3, the transverse dimension of main head 10 or lead-in heads 34 may be varied as a function of the compactness of the layer of ground 2 being worked by main head 10. In other words, when main head 10 encounters a particularly compact layer of ground 2, the transverse dimension of main head 10 is reduced to a given minimum; and, conversely, when main head 10 encounters a soft layer of ground 2, the transverse dimension of main head 10 is increased to a given maximum. The transverse dimension of main head 10 may be increased or reduced, for example, by means of an actuator for producing relative slide between at least two peripheral portions of plate 12 of main head 10. Varying the transverse dimension of main head 10, as it is driven in, also varies the transverse dimension of channel 28.

The variable transverse dimension of main head 10 may be made use of when building foundation structure 1. That is, as opposed to being aligned with hole 4 beneath foundation structure 1, main head 10 is inserted through hole 4 when driving pile 3, and is then expanded on contacting ground 2. In other words, main head 10 is contracted to a smaller transverse dimension than hole 4 so as to fit through hole 4, and is then expanded to a larger transverse dimension than hole 4 to form channel 28. This solution is particularly useful when working with an existing foundation structure 1.

In an alternative embodiment, the possibility, described above, of varying the transverse dimension of main head 10, as it is driven into ground 2, may also be used to increase the transverse dimension of the end portion of channel 28, and so form a relatively-wide-bulb at the bottom end portion of pile 3 to increase the ground supporting surface, and hence, the capacity of pile 3. Alternatively, the transverse dimension of the end portion of pile 3 may be increased to form such a bulb by pulling main head 10 upwards to deform the end portion of rod 9.

Figure 10:
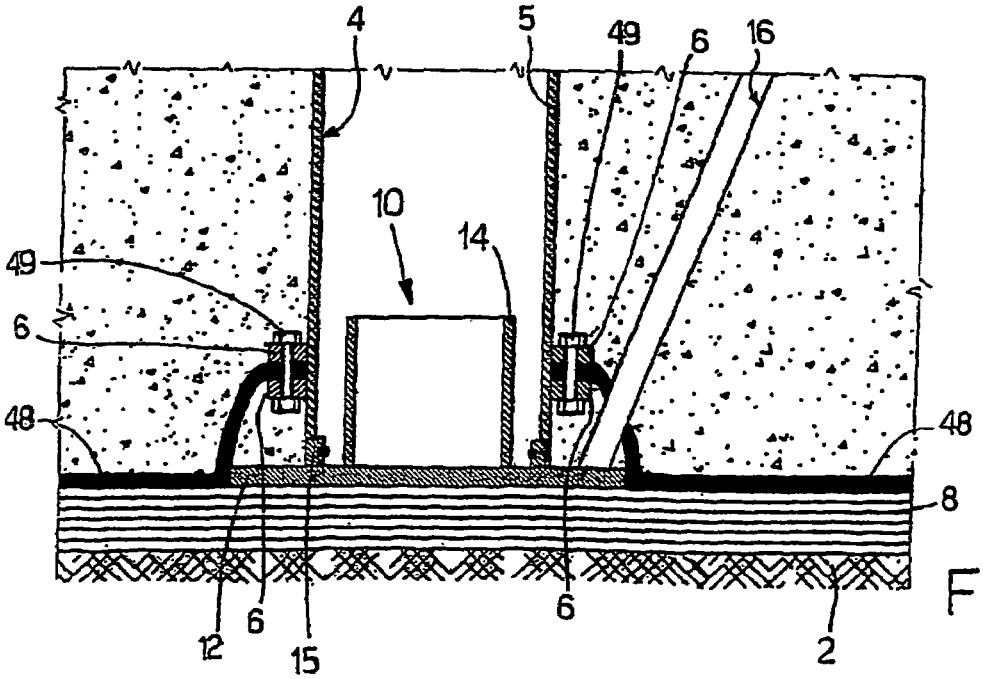
FIG. 10 shows a larger-scale front section of an initial configuration, prior to driving an alternative embodiment of the FIG. 1 pile.

As shown in FIG. 10, when building foundation structure 1, an insulating sheath 48 is interposed between foundation structure 1 and ground 2 (or between foundation structure 1 and lean cement layer 8, if any) to protect foundation structure 1 from infiltration by water. At each hole 4, insulating sheath 48 obviously comprises a corresponding hole for the passage of relative pile 3. More specifically, insulating sheath 48 is fixed to respective lining pipe 5 by inserting the free edge of sheath 48 between two rings 6, and inserting through insulating sheath 48 a number of screws 49, each of which is bolted to the two rings 6. Though not illustrated in detail, a similar fastening system may also be used to fix sheath 48 to pipe 17 of injection conduit 16.

In the FIG. 11 embodiment, injection conduit 16 shown in the previous drawings is eliminated, and cement material 31 is injected into outer tubular portion 30 of channel 28 by an injection conduit 50, which is defined by a pipe 51 made of flexible material and having a bottom end at a through hole 52 in rod 9, and a top end connected to an injection device (not shown). Hole 52 is located close to main head 10 to inject cement material 31 into outer tubular portion 30 of channel 28 upwards, as opposed to downwards like injection conduit 16. Injecting cement material 31 upwards as opposed to downwards has the advantage of forming "enlargements" of cement material 31 at various heights. In the preferred embodiment shown in FIG. 11, a number of holes 52 are provided at the same height and symmetrically about the central axis of rod 9, so as to inject cement material 31 simultaneously from a number of points. In an alternative embodiment not shown, holes 52 are located at different heights along rod 9, and may be fed by one or more pipes 51, when driving pile 3 (possibly in a number of non-simultaneous stages) or even after pile 3 is driven. Once cement material 31 is injected, pipe 51 can either be removed from or left inside conduit 11 of rod 9.

It is important to note that, prior to driving pile 3, any water beneath foundation structure 1 can be sucked out along injection conduit 16 or 50.

Figure 14:
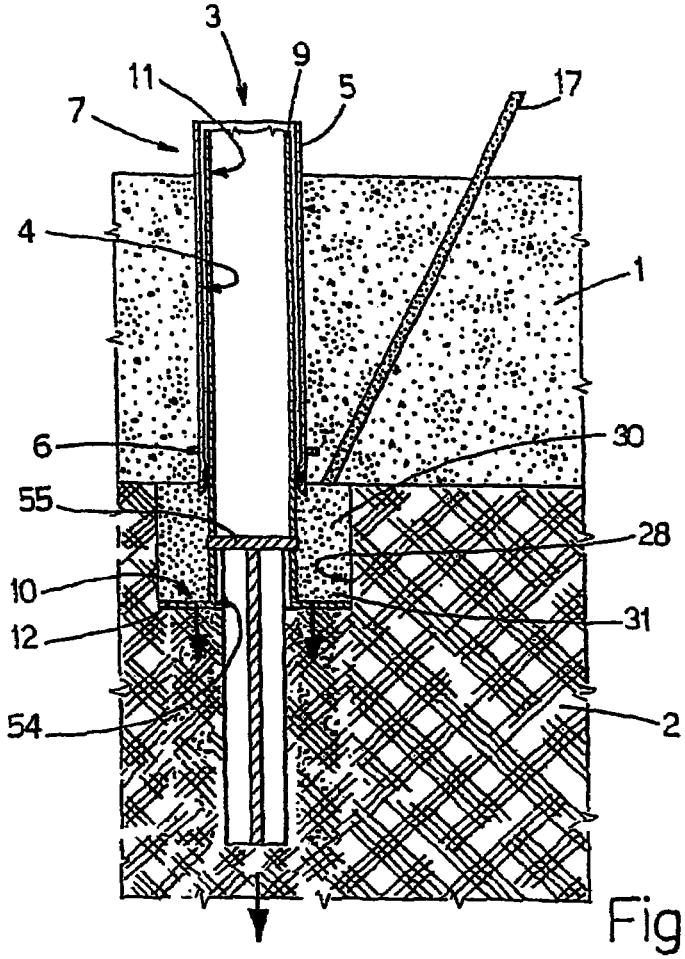
FIGS. 12 to 14 show two stages in the driving of an alternative embodiment of the FIG. 1 pile.
Figure 13:
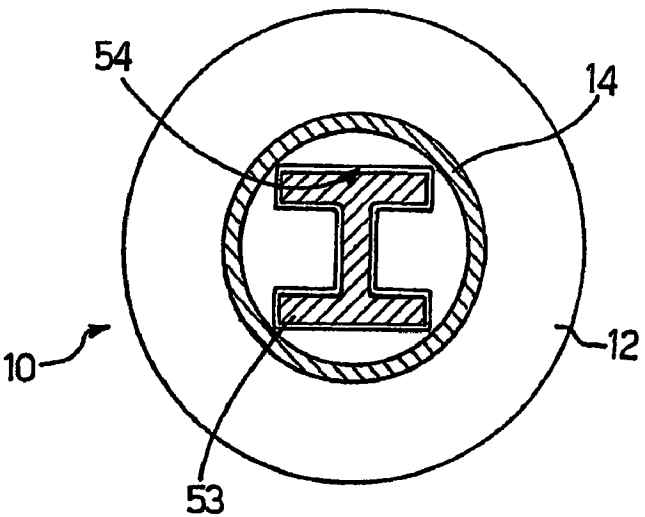
Figure 12:
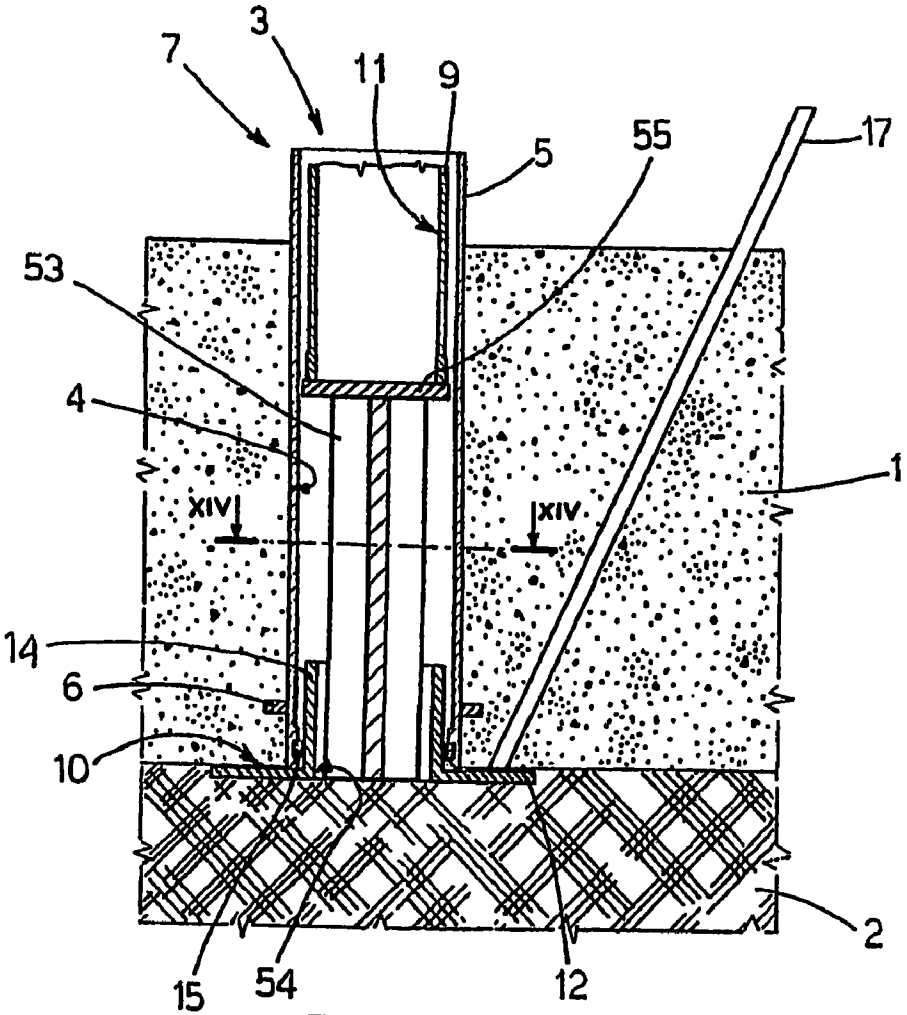

In the FIG. 12-14 embodiment, prior to inserting rod 9 inside respective hole 4, a beam 53, preferably an I-beam (shown clearly in FIG. 13), is inserted inside hole 4 and inside connecting member 14 of main head 10, so as to face a through slot 54 formed in plate 12 of main head 10 and shaped and sized to permit passage of beam 53. Before rod 9 is inserted, the bottom end of beam 53 is fitted through slot 54 to rest on ground 2 in the position shown in FIG. 12.

A plate 55, at least as large across as rod 9, is placed on the top end of beam 53. When rod 9 is inserted inside hole 4, the bottom end of rod 9 rests on the top surface of plate 55. When rod 9 is subjected to downward thrust, this is transmitted by plate 55 to beam 53, which therefore begins to sink into ground 2. As plate 55 comes to rest on the top end of connecting member 14, the downward thrust on rod 9 is transferred to both main head 10 and beam 53, which both sink together into ground 2 as shown in FIG. 14. Obviously, in an alternative embodiment not shown, beam 53 may be replaced by an elongated member of any type, e.g. a tubular member or channel section.

The purpose of beam 53 is to define a bottom extension of pile 3 with respect to main head 10. This is useful when the downward movement of main head 10 is arrested by main head 10 coming to rest on a particularly compact, tough, deep ground layer; in which case, beam 53 penetrates the deep layer of ground 2 beneath main head 10 to increase the capacity of pile 3.

As stated above, varying the transverse dimension of main head 10 (and possibly also of a lead-in head 34), when sinking main head 10, also varies the transverse dimension of channel 28, thus enabling the formation of a pile 3 varying freely in transverse dimensions along its longitudinal axis. In other words, pile 3 may comprise, about rod 9, intermediate or end segments of cement material 31 larger across than the rest of pile 3 and commonly referred to as "enlargements".

Besides varying the transverse dimension of main head 10 (and possibly also of a lead-in head 34) when driving the pile, "enlargements", i.e. intermediate or end segments of cement material 31 larger across than the rest of pile 3, can also be formed using the FIG. 11 embodiment, in which cement material 31 is injected into channel 28 through one or more holes 52 located along rod 9, and by varying the quantity and pressure of cement material 31 injected when driving pile 3. As stated, material may be fed through holes 52 while driving pile 3 (possibly in a number of non-simultaneous stages) or even after pile 3 is driven.

It is important to stress that rod 9 is normally formed by joining a number of segments driven successively into ground 2. As such, the thickness of the various component segments of rod 9 may also be varied, so as to obtain, along the longitudinal axis of pile 3, not only different thicknesses of cement material 31, but also different thicknesses of metal rod 9.

In an alternative embodiment not shown, main head 10 is substantially the same size across as rod 9, and is pointed as described previously. Obviously, in this embodiment, the channel 28 formed by the pointed main head 10 penetrating ground 2 when driving pile 3 is the same size across as rod 9, so that no cement material 31 can be injected. This embodiment is used when pile 3 is driven into waterlogged or underwater ground 2.

When building foundation structure 1 or driving piles 3, temporary piles (not shown in detail) may need to be driven into ground 2 to form, for example, temporary structures, and which must be removed once work is completed. To extract a temporary pile from ground 2, a method similar to that described for driving piles 3 may be used. That is, the temporary pile is subjected to static pull generated by an extracting device connected mechanically at one end to the top end of the temporary pile, and resting at the other end on foundation structure 1, which acts as a reaction member for the extracting device. More specifically, the extracting device preferably comprises at least two hydraulic jacks on opposite sides of the temporary pile; the movable rod of each hydraulic jack is fixed to a horizontal plate connected rigidly to the temporary pile; and the bodies of the two hydraulic jacks rest on foundation structure 1.

The above description illustrates numerous embodiments by which to form each pile 3, and the characteristics of which may obviously be variously combined, depending on the characteristics of the building, the characteristics of ground 2, and the desired end result.

As will be clear from the foregoing description, each pile 3 typically comprises a cylindrical metal core (rod 9) filled with concrete 32 and enclosed in a jacket of betoncino 31. Each pile 3 is driven statically with substantially no material being extracted from ground 2, and is sunk into ground 2 by simply compacting the regions through which it travels. As such, ground 2 on which the pile foundation stands is renewed and compacted, and a substantially clean construction site is obtained by eliminating the earth-moving and excavation work required by drilled piles.

It should be pointed out that, being performed statically using hydraulic jacks, each pile 3 is driven with absolutely no vibration or noise, so that the static and stability of any buildings in the vicinity of foundation structure 1 are in no way affected.

Finally, it should be noted that, by building foundation structure 1 shortly before the pile foundation, overall work time can be reduced by simultaneously driving piles 3 and constructing the superstructures (not shown) supported by foundation structure 1.

The invention claimed is:

1. A method of constructing a pile foundation; the method comprising the steps of:

building on the ground (2) a foundation structure (1) having at least one through hole (4);

inserting a metal pile (3), comprising a rod (9) and at least one bottom main head (10), through said hole (4), so that the main head (10) of the pile (3) contacts the ground (2);

statically applying at least one thrust on the pile (3) to drive the pile (3) into the ground (2); and fixing the driven pile (3) axially to the foundation structure (1);

the method being characterized in that the transverse dimensions of the main head (10) are greater than those of the hole (4) when driving the main head (10) into the ground.

2. A method as claimed in claim 1, wherein the main head (10) is initially detached from the rod (9), and, when building the foundation structure (1), is positioned contacting the ground (2) beneath the foundation structure (1) and substantially coaxial with the hole (4); the rod (9) engaging the main head (10) when the rod (9) is inserted through the hole (4).

3. A method as claimed in claim 1, wherein the transverse dimension of the main head (10) is adjustable, and the main head is contracted to a transverse dimension smaller than that of the hole (4) for insertion through the hole (4), and is then expanded to a transverse dimension larger than that of the hole (4) on contacting the ground (2).

4. A method as claimed in claim 3, wherein the transverse dimension of the main head (10) is adjusted by means of an actuator producing relative slide between at least two portions of the main head (10).

5. A method as claimed claim 1, wherein at least one connecting member (5) is fixed to the foundation structure (1), adjacent to the hole (4); the static thrust on the pile (3) to drive the pile (3) into the ground (2) being applied using the foundation structure (1) as a reaction member.

6. A method as claimed in claim 5, wherein appropriate ballast, resting on the foundation structure (1), is added to the foundation structure (1) at the hole (4).

7. A method as claimed in claim 1, wherein drive ballast, physically separate from and not resting on the foundation structure (1), is provided; the static thrust on the pile (3) to drive the pile (3) into the ground (2) being applied using the drive ballast as a reaction member.

8. A method as claimed in claim 7, wherein the drive ballast comprises a mass resting on the ground (2).

9. A method as claimed in claim 8, wherein the mass of the drive ballast is fixed temporarily to the ground (2) by means of a number of auxiliary piles or screws driven temporarily into the ground (2).

10. A method as claimed in claim 8, wherein the mass of the drive ballast is mounted on a movable structure.

11. A method as claimed in claim 1, wherein thrust is applied by means of a respective thrust device (21) comprising at least two hydraulic jacks located on opposite sides of the rod (9); the movable output member of each hydraulic jack is fixed to a fixed horizontal plate, and the bodies of the two hydraulic jacks grip the rod (9) to engage the rod (9) and draw the rod (9) downwards when the output members of the jacks are extracted from the bodies of the hydraulic jacks; and the bodies of the two hydraulic jacks grip the rod (9) by means of wedges, which tend to compress the rod (9) as the bodies of the hydraulic jacks descend.

12. A method as claimed in claim 1, wherein the main head (10) comprises a connecting member (14) for engaging the rod (9) and fixing the rod (9) transversely to the main head (10); the rod (9) is defined by a cylindrical pipe having an inner conduit (11); the connecting member (14) is defined by a cylindrical member which engages a bottom portion of the inner conduit (11).

13. A method as claimed in claim 1, wherein the rod (9) is defined by a cylindrical pipe having an inner conduit (11); once driving is completed, a substantially plastic first cement material (32) defined by concrete is fed into the inner conduit (11).

14. A method as claimed in claim 1, wherein the main head (10), as it is being driven, forms in the ground (2) a main channel (28) of larger transverse dimensions than the rod (9);

a substantially plastic second cement material (31) is fed into the portion (30) of the main channel (28) not occupied by the rod (9).

15. A method as claimed in claim 14, wherein an injection conduit (16) is formed through the foundation structure (1), and has a first end (18) projecting from the foundation structure (1), and a second end (19) terminating on the ground (2) adjacent to the hole (4) and at the pertinent portion of the main channel (28); the second cement material (31) is pressure injected into the main channel (28) along the injection conduit (16).

16. A method as claimed in claim 15, wherein, prior to driving the pile (3), any water beneath the foundation structure (1) is sucked out along the injection conduit (16).

17. A method as claimed in claim 14, wherein the second cement material (31) is pressure injected by means of an injection conduit (50), which is defined by at least one pipe (51) having a bottom end located at least one through hole (52) in the rod (9).

18. A method as claimed in claim 17, wherein the through hole (52) in the rod (9) is located close to the main head (10).

19. A method as claimed in claim 17, wherein the second cement material (31) is pressure injected by means of the injection conduit (50) when driving the pile (3) in a number of non-simultaneous stages.

20. A method as claimed in claim 17, wherein the second cement material (31) is pressure injected by means of the injection conduit (50) after the pile (3) is driven.

21. A method as claimed in claim 17, wherein, prior to driving the pile (3), any water beneath the foundation structure (1) is sucked out along the injection conduit (50).

22. A method as claimed in claim 14, wherein the hole (4) is fitted inside with a sealing ring (15) which engages the outer cylindrical surface of the rod (9) when the rod (9) is inserted through the hole (4).

23. A method as claimed in claim 14, wherein at least one additive is added to the second cement material (31) to reduce potential adhesion of the ground (2) to the second cement material (31).

24. A method as claimed in claim 14, wherein at least one waterproofing additive is added to the second cement material (31) to make the second cement material (31) substantially impermeable to water even prior to curing.

25. A method as claimed in claim 24, wherein, when working through a bed of moving water, the second cement material (31) is injected at a pressure higher than the pressure exerted by the moving water.

26. A method as claimed in claim 1, wherein at least one connecting member (5) is fixed to the foundation structure (1), adjacent to the hole (4); the pile (3) being fixed axially to the foundation structure (1) by securing to the connecting member (5) a horizontal metal plate (33) placed on top of the pile (3) to engage a top end (22) of the pile (3).

27. A method as claimed in claim 26, wherein a body of elastic material is interposed between the metal plate (33) and the top end (22) of the pile (3).

28. A method as claimed in claim 1, wherein at least one connecting member (5) is fixed to the foundation structure (1), adjacent to the hole (4); the connecting member (5) being defined by a cylindrical metal lining pipe (5), which lines the hole (4), has a portion (7) projecting upwards from the foundation structure (1), and is fixed to the foundation structure (1).

29. A method as claimed in claim 28, wherein the metal pipe (5) is fixed to the foundation structure (1) by at least one metal ring (6) integral with the foundation structure (1).

30. A method as claimed in claim 29, wherein the metal pipe (5) is fixed to the foundation structure (1) by at least two metal rings (6) integral with the foundation structure (1); an insulating sheath (48) is interposed between the foundation structure (1) and the ground (2); and the insulating sheath (48) is fixed, at the hole (4), to the metal pipe (5) by inserting the free edge of the insulating sheath (48) between the two rings (6), and inserting through the insulating sheath (48) a number of screws (49), each of which is bolted to the two rings (6).

31. A method as claimed in claim 1, wherein the rod (9) is made of metal, and comprises a number of segments, which can be identical or of different shape and/or thickness, are driven successively through the respective said hole (4), and are joined to one another to define the rod (9).

32. A method as claimed in claim 1, wherein the main head (10) comprises a substantially circular, flat plate (12) having a jagged outer edge (13).

33. A method as claimed in claim 1, wherein the pile (3) comprises at least one lead-in head (34) coaxial with and below the main head (10), which has a central opening (37); the lead-in head (34) comprising an elongated body (36), which extends upwards through the central opening (37) in the main head (10) and engages a bottom end (38) of the rod (9).

34. A method as claimed in claim 33, wherein the main head (10) engages the rod (9) with the interposition of at least one portion (39) of the elongated body (36) of the lead-in head (34).

35. A method as claimed in claim 34, wherein the rod (9) is defined by a cylindrical pipe having an inner conduit (11); the elongated body (36) of the lead-in head (34) is defined by a cylindrical tubular body (36), which is inserted inside the inner conduit (11) and comprises a ring (39) connected integrally to an outer surface of the tubular body (36) and which engages the bottom end (38) of the rod (9) to secure the rod (9) axially to the tubular body (36); the main head (10) engages the rod (9) with the interposition of the ring (39).

36. A method as claimed in claim 33, wherein the lead-in head (34), as it is being driven, forms in the ground (2) a lead-in channel (40) of transverse dimensions larger than those of an elongated body (36) connected to the lead-in head (34); a substantially plastic second cement material (31) is fed into the portion of the lead-in channel (40) not occupied by the elongated body (36) simultaneously with the driving of the pile (3).

37. A method as claimed in claim 36, wherein the second cement material (31) is pressure injected along an injection conduit, which is defined by at least one pipe having a bottom end located at the lead-in head (34).

38. A method as claimed in claim 37, wherein the elongated body (36) is a tubular body having an inner channel along which the pipe defining the injection conduit is located.

39. A method as claimed in claim 33, wherein the lead-in head (34) is fixed to a respective elongated body (36) by means of a connecting mechanism allowing the lead-in head (34) to slide with respect to the elongated body (36).

40. A method as claimed in claim 39, wherein the connecting mechanism is remote-controlled by an actuator.

41. A method as claimed in claim 39, wherein the connecting mechanism releases slide of the lead-in head (34) with respect to the elongated body (36), when the force exerted on the lead-in head (34) exceeds a given threshold value.

42. A method as claimed in claim 33, wherein the pile (3) comprises a number of lead-in heads (34) located coaxially with and beneath the main head (10), and which form in the ground (2) a lead-in channel (40) defining a "lead-in" by which to drive the main head (10); the lead-in heads (34) increasing in transverse dimensions so as to gradually increase the transverse dimensions of the lead-in channel (40).

43. A method as claimed in claim 33, wherein the bottom portion of at least the bottom lead-in head (34) is pointed.

44. A method as claimed in claim 43, wherein the inclination of the pointed tip of the bottom lead-in head (34) is adjustable, when driving the pile (3), as a function of the characteristics of the ground (2).

45. A method as claimed in claim 43, wherein the bottom lead-in head (34) is rotated at a given speed about its central axis of symmetry.

46. A method as claimed in claim 45, wherein the bottom lead-in head (34) comprises a number of helical grooves to screw the bottom lead-in head (34) into the ground (2).

47. A method as claimed in claim 33, wherein the transverse dimension of the lead-in head (34) is adjusted when driving the pile (3).

48. A method as claimed in claim 47, wherein the transverse dimension of the lead-in head (34) is adjusted by means of an actuator producing relative slide between at least two portions of the lead-in head (34).

49. A method as claimed in claim 1, wherein the main head (10) is pointed.

50. A method as claimed in claim 49, wherein the inclination of the pointed tip of the main head (10) is adjustable, when driving the pile (3), as a function of the characteristics of the ground (2).

51. A method as claimed in claim 50, wherein the inclination of the pointed tip of the main head (10) clicks between at least two distinct configurations, so as to adjust, when driving the pile (3), to the characteristics of the ground (2).

52. A method as claimed in claim 49, wherein the main head (10) is rotated at a given speed about its central axis of symmetry.

53. A method as claimed in claim 52, wherein the main head (10) comprises a number of helical grooves to screw the main head (10) into the ground (2).

54. A method as claimed in claim 1, wherein a metal plate is placed about the hole (4), has a central hole corresponding with the hole (4), and is connected to the foundation structure (1) by means of a number of screws.

55. A method as claimed in claim 1, wherein, prior to fixing the pile (3) axially to the foundation structure (1), the pile (3) is preloaded with a downward thrust of given intensity.

56. A method as claimed in claim 1, wherein, when driving the pile (3), the rod (9) of the pile (3) is rotated about its vertical axis of symmetry.

57. A method as claimed in claim 1, wherein, prior to driving the pile (3), a pre-channel (45) is formed coaxial with the main head (10).

58. A method as claimed in claim 57, wherein the pre-channel (45) has a transverse dimension slightly larger than the transverse dimension of the main head (10), and the inner walls of the pre-channel (45) are lined with a sheet metal liner (48).

59. A method as claimed in claim 57, wherein the pre-channel (45) is filled with low-strength material (46).

60. A method as claimed in claim 1, wherein the transverse dimension of the main head (10) is adjusted when driving the pile (3).

61. A method as claimed in claim 60, wherein the transverse dimension of the main head (10) is adjusted by means of an actuator producing relative slide between at least two portions of the main head (10).

62. A method as claimed in claim 60, wherein the main head (10), as it is being driven, forms in the ground (2) a main channel (28) of transverse dimensions larger than those of the rod (9); a substantially plastic second cement material (31) is fed into the portion (30) of the main channel (28) not occupied by the rod (9) simultaneously with the driving of the pile (3); the possibility of adjusting the transverse dimension of the main head (10), as the main head (10) is driven into the ground (2), is used to increase the transverse dimension of the main channel (28) at the end portion of the main channel (28), so as to form a bulb of relatively large transverse dimensions at the bottom end portion of the pile (3).

63. A method as claimed in claim 62, wherein the transverse dimension of the end portion of the pile (3) is increased by drawing the main head (10) upwards to deform the end portion of the rod (9).

64. A method as claimed in claim 1, wherein, prior to inserting the rod (9) inside the respective hole (4), an elongated member (53) is inserted inside the hole (4), so that the elongated member (53) faces a through slot (54) formed in the main head (10) and shaped and sized to permit passage of the elongated member (53); a plate (55), having a transverse dimension at least equal to that of the rod (9), is placed on top of the elongated member (53), and, when the rod (9) is inserted inside the hole (4), the bottom end of the rod (9) resting on the top surface of the plate (55) to push the elongated member (53) down and bring the plate (55) into contact with the main head (10); as the plate (55) comes to rest on the top end of the main head (10), the downward thrust exerted on the rod (9) is transferred to both the main head (10) and the elongated member (53), so that the main head (10) and the elongated member (53) sink together into the ground (2).

65. A method as claimed in claim 1, wherein the main head (10) is fixed to the rod (9) by means of a connecting mechanism allowing the main head (10) to slide with respect to the rod (9).

66. A method as claimed in claim 65, wherein the connecting mechanism is remote-controlled by an actuator.

67. A method as claimed in claim 66, wherein the connecting mechanism releases slide of the main head (10) with respect to the rod (9), when the force exerted on the main head (10) exceeds a given threshold value.

68. A method as claimed in claim 1, wherein the rod (9) of the pile (3) differs in thickness and/or shape along the longitudinal axis of the pile (3); the rod (9) is made of metal, and comprises a number of segments, which are driven successively through the respective hole (4) and are joined to one another to define the rod (9); the component segments of the rod (9) differ in shape and/or thickness.

69. A method as claimed in claim 1, wherein the pile (3) comprises a jacket of cement material (31) surrounding the rod (9); the transverse dimension of the jacket of cement material (31) of the pile (3) differs along the longitudinal axis of the pile (3).

70. A method as claimed in claim 69, wherein the difference in the transverse dimension of the jacket of cement material (31) is achieved by adjusting the transverse dimension of the main head (10) as the main head (10) is driven in.

71. A method as claimed in claim 70, wherein the difference in the transverse dimension of the jacket of cement material (31) is achieved by differentially injecting the cement material (31) through at least one through hole (52) formed along the rod (9).

72. A method as claimed in claim 1, and comprising the steps of driving at least one auxiliary pile into the ground (2) when building the foundation structure (1); and removing the auxiliary pile once the foundation structure (1) is completed by statically subjecting the auxiliary pile to pull generated by an extracting device connected mechanically at one end to a top end of the auxiliary pile, and resting at the other end on the foundation structure (1), which acts as a reaction member.

* * * * *